US005365223A

United States Patent [19]

Sigafus

[11] Patent Number: 5,365,223

[45] Date of Patent: Nov. 15, 1994

[54] FAIL-SAFE CONDITION SENSING CIRCUIT

[75] Inventor: Paul E. Sigafus, Medina

[73] Assignee: Honeywell Inc., Minneapolis, Minn.

[21] Appl. No.: 783,950

[22] Filed: Oct. 28, 1991

[51] Int. Cl.[5] ..... G08B 23/00; G08B 17/12; F23N 5/08

[52] U.S. Cl. ..... 340/693; 340/578; 431/79

[58] Field of Search ..... 340/578–579, 340/511, 587, 507, 693, 660–664; 250/554, 372; 328/6; 357/30; 307/75; 431/79, 24; 324/71.1; 361/175; 364/557

[56] References Cited

U.S. PATENT DOCUMENTS

| | | | |
|---|---|---|---|
| Re. 29,143 | 2/1977 | Bianchini | 361/175 |
| 3,283,154 | 11/1966 | Giuffrida et al. | 250/372 |
| 3,734,676 | 5/1973 | Wyland | 431/79 |
| 3,943,386 | 3/1976 | Simeau | 340/579 X |
| 4,280,184 | 7/1981 | Weiner et al. | 364/506 |
| 4,328,527 | 5/1982 | Landis | 361/175 |
| 4,494,924 | 1/1985 | Tanaka et al. | 431/78 |
| 4,540,886 | 9/1985 | Bryant | 250/554 |
| 4,578,583 | 3/1986 | Ciammaichella et al. | 250/339 |
| 4,923,117 | 5/1990 | Adams et al. | 340/511 X |
| 5,077,550 | 12/1991 | Cormier | 340/578 |

FOREIGN PATENT DOCUMENTS

| | | | |
|---|---|---|---|
| 2631454 | 1/1978 | Germany | 340/578 |
| 189216 | of 1984 | Japan | 431/79 |
| 1168992 | 7/1985 | U.S.S.R. | 340/578 |

OTHER PUBLICATIONS

Patent Abstracts of Japan, vol. 9, No. 194 (M-403) (1917), re Japanese publication 60-57126, Aug. 1985.

*Primary Examiner*—John K. Peng
*Assistant Examiner*—Thomas J. Mullen, Jr.
*Attorney, Agent, or Firm*—Edward L. Schwarz

[57] ABSTRACT

A circuit for detecting whether the level of an electrical signal having a preselected polarity is above a preselected value, is powered by DC of the opposite polarity. This prevents current leakage within the detector circuit from simulating the level of the electrical signal. Such a circuit is particularly suited for detecting the current level provided by a flame sensor in a combustion control system. The preferred embodiment has a capacitor which is charged by the circuit and then discharged by the electrical signal. The time required to discharge the capacitor to a preselected level indicates the level of the electrical signal. A second embodiment uses a comparator in a feedback loop which allows sensing the level of a voltage outside of the voltage range defined by the comparator's power supply.

13 Claims, 3 Drawing Sheets

FAIL-SAFE CONDITION SENSING CIRCUIT

BACKGROUND OF THE INVENTION

The invention pertains to a high reliability signal sensing circuit particularly suited for use as an electronic flame sensing circuit forming a part of a burner control apparatus. The invention is described with specific reference to such a flame sensing use, but other applications for use of the invention undoubtedly exist as well. Generally, a flame sensing circuit includes a sensor element physically located close to the site of the flame so as to provide a sensor signal having a predetermined level or operating state when a flame is present and some other level or operating state when flame is not present. The signal supplied directly by the sensor may by its level indicate the level of ultraviolet or infrared radiation produced by the flame when present, or may directly sense presence of the hot flame gasses. Typically, there is a processing or detector circuit which receives the sensor signal, which is usually in an analog format, and converts it into a signal which has a form usable by the burner control or other apparatus basing its operation on the sensor signal. The processing or detector circuit may be located relatively close to the flame, and connected to the flame sensor.

One typical type of flame sensor is generally referred to as a flame rod, and uses the inherent capability of the ionized particles created by a flame to conduct current between conductors placed in the flame. In a preferred embodiment of such a device, the two conductors are the flame rod conductor of relatively small area and the burner itself of relatively large area. The difference in areas creates a rectifier effect in the conduction of an AC voltage placed between the flame rod and the burner. Because the burner is relatively larger than the flame rod, the rectifier formed by them produces a negative DC voltage. There is no theoretical reason why the burner cannot be physically smaller than the flame rod, but practical considerations dictate the opposite, so that the flame current generated by a flame rod may be considered for the discussion following as negative. However, the principles of the invention is equally applicable for a positive sensor signal.

It is important that such sensors and the circuits with which they operate be extremely reliable in detecting presence of flame, since whenever flame is not present it is of paramount importance that fuel flow to the burner be immediately stopped, and in the case of a pilot flame, not be started. It is of course inconvenient if the sensing circuit indicates absence of a flame when in fact there is flame present, because this results in emergency shutdown of fuel flow to the burner. However, this condition does not create any serious safety hazard.

There have heretofore been a variety of designs which have been used which attempt to immunize the sensors and sensing circuits against failures of all sorts whose effect is to simulate presence of a flame which is actually not present. Some approaches include redundant signal paths or redundant components. Others use frequent brief tests of the sensor and/or sensing circuit which identify faulty operation of the sensor or circuit very quickly after the fault occurs. Some test the circuit each time during the burner startup sequence. Such tests may be done for example by injecting a simulated sensor signal into the circuit.

However, certain types of failures in the flame sensing circuitry can closely mimic the signal normally provided by the sensor in response to presence of flame. This situation can arise for example, where a voltage normally present on the detector's circuit board leaks into the signal path and simulates a signal level indicative of presence of flame. While frequent testing can detect many of these failures, it is difficult to completely avoid the potential for a certain number of such events to cause improper indication of presence of flame. In the situation where the circuit is attempting to detect flames, even one failure to properly do so is too many.

Accordingly, the safety of burner control systems and other safety critical systems can be improved by reducing or eliminating the possibility of leakage currents which simulate actual sensor signal levels indicative of flame.

BRIEF DESCRIPTION OF THE INVENTION

Faulty indications of system operation arising from simulation of a flame present or other predetermined condition of a sensor signal by a leakage current in a detector circuit can be eliminated or substantially reduced in likelihood by using a sensor providing a signal having a predetermined level indicating the safety critical condition, and which level is of polarity opposite that of the DC power which energizes the detector circuit receiving and conditioning the sensor signal.

Such apparatus for signaling presence of a predetermined condition may have a sensor having a power terminal for receiving power from a power supply. The sensor provides, responsive exclusively to existence of the predetermined condition and to presence of operating power on the power terminal, a sensor signal within a predetermined signal voltage range offset in a first direction from a common voltage level. Typically the common voltage level is 0 volts or ground. The detector circuit also has a power terminal on which it receives power for its operation. The detector circuit receives the sensor signal from the sensor and provides the condition signal with the predetermined level responsive exclusively to the sensor signal level falling within the predetermined signal voltage range and to presence of operating power on the detector power terminal within a predetermined power voltage range offset in a second direction different from the offset direction of the predetermined signal voltage range. A second power supply provides operating power within the predetermined power voltage range to the detector's power terminal.

There are two different preferred embodiments. The detector in the first embodiment uses a special differential amplifier which can detect a signal voltage outside of the voltage range defined at its end points by the power voltage which operates it. The detector in the quasi-digital embodiment uses a capacitor which is periodically charged by the detector circuit, and then discharged by the sensor signal. The rate at which the sensor signal discharges the capacitor is an indication of the level of the sensor signal. This rate is measured by a counting procedure which yields a digital value indicative of the sensor signal level.

Accordingly, one purpose of the invention is to provide a highly reliable indication of the presence of a predetermined condition.

Another purpose is to provide a sensor whose output signal polarity responsive to the presence of the predetermined condition is opposite the polarity of the condition signal which signals the presence of the condition.

DESCRIPTION OF THE PREFERRED EMBODIMENTS

Figure 1:
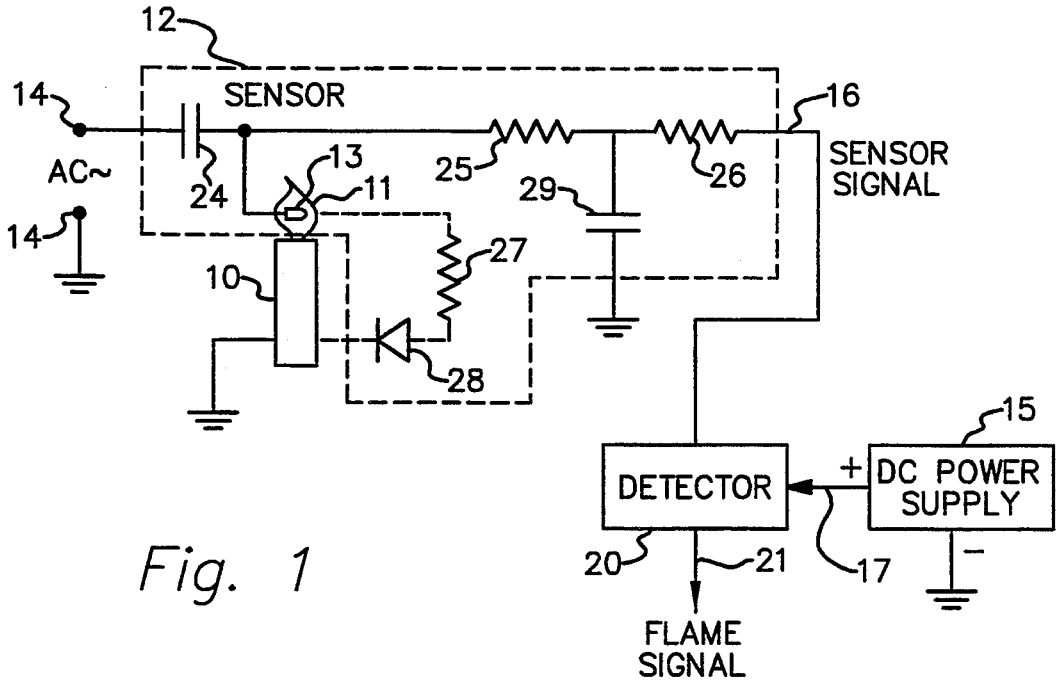
FIG. 1 is a block diagram generally illustrating the invention.

The block diagram of FIG. 1 generally displays the main features of the invention. In this generalized embodiment, a burner 10 provides a flame 11 which represents the predetermined condition to be monitored by a circuit constructed according to the teachings of the subject invention. A sensor 12 is shown in juxtaposition to the burner 10 so that the sensor output on path 16 varies as the flame is and is not present. The sensor 12 has been shown here as of the flame rod type, wherein a flame rod 13 is positioned to be directly within volume occupied by the flame 11 when present. AC voltage is constantly present on terminals 14. A capacitor 24 prevents flow of direct current into the AC voltage source from the detector 20 and its associated power supply 15 which will reduce the sensitivity with which flame may be detected.

When flame is present, the electrical characteristics of flame rod 11 and burner 10 in combination may be represented by the resistor 27 and diode 28, shown connected by dotted lines between rod 11 and burner 10. One can see that excursions of the AC voltage on terminals 14 above ground will be greatly reduced by the rectifier effect of rod 13 and burner 10 when flame is present. Excursions below ground when flame is present will be attenuated slightly, but in general, flame causes a negative current flow through resistors 25 and 26 which appears on the path 16 as the sensor signal. Capacitor 29 filters the flame signal generated by the rectifier action of the flame rod 13. Of course, when flame is not present, a balanced AC current flows through resistor 25 and is for the most part conducted to ground by filter capacitor 29. Therefore, little current of either polarity appears on path 16. In a preferred embodiment, the nominal voltage which sensor 12 provides on path 16 when the flame is present is around −100 mv. The no flame voltage on path 16 may be −10 mv. Current flow to sensor 12 is substantially proportional to the voltage on path 16. Thus, sensor 12 may also be considered to comprise a variable source of electric current whose output current magnitude is lesser and greater (less or more negative in this embodiment) responsive respectively to absence and presence of flame.

Figure 2:
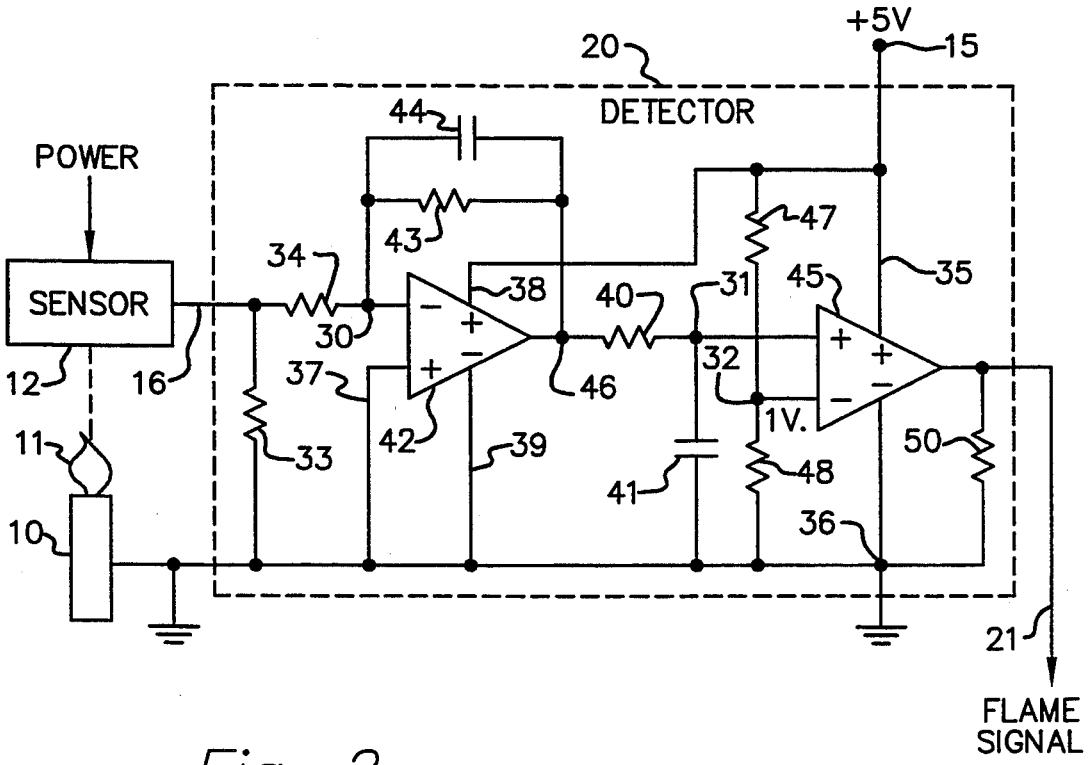
FIG. 2 is a circuit diagram embodying a preferred design for the invention.
Figure 3:
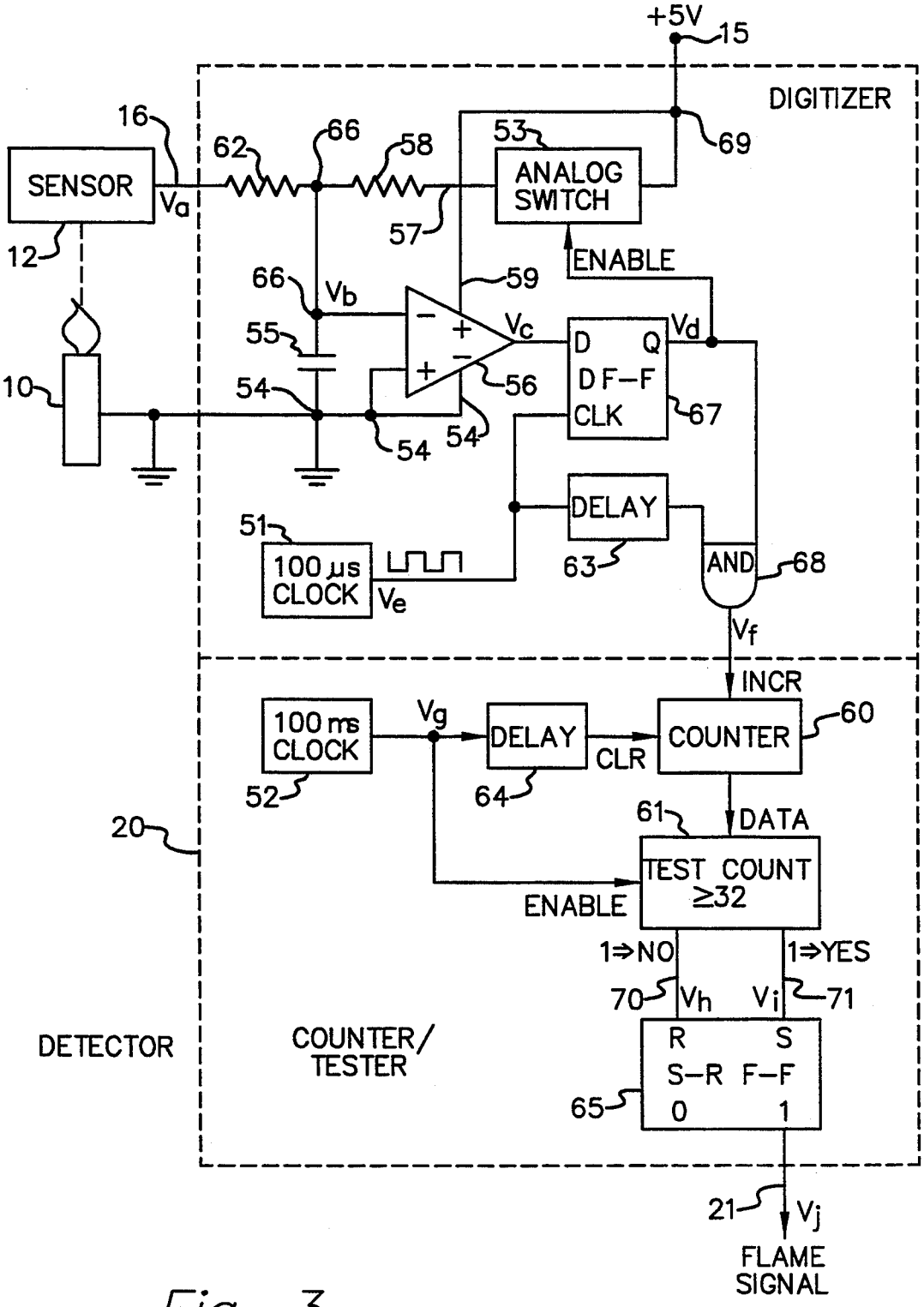
FIG. 3 is a block diagram of an alternate preferred embodiment of the invention.

Because of the extremely small change in voltage produced by a sensor such as that shown, it is necessary to provide a special detector circuit 20 such as those shown in FIGS. 1, 2, and 3 in order to accurately sense presence of this voltage and convert it to a level which is usable by the burner's control circuitry. Of course, other types of sensors may be used as well, and whatever power supply is used should be chosen for compatibility with whichever one of the various types of sensors 12 is used.

A detector 20 receives the sensor signal on path 16, and provides at its output path 21 the condition signal, which is labeled in FIG. 1 as a flame signal. Detector 20 comprises circuitry which is powered by a separate and distinct DC power supply 15 which provides at a power terminal 17 of detector 20, power whose voltage potential is offset from the common (ground) voltage level in the direction opposite from the potential of the signal on path 16. That is, where sensor 12 provides a signal on path 16 whose potential is negative relative to a common (ground) potential, then detector 20 must have a design which operates on power provided between + and − terminals of a power supply 15 whose − terminal is connected to ground. There are any number of different possible configurations for detector 20, of which two are shown in FIGS. 2 and 3. Regardless, with detector 20 operating between + voltage and ground, it is easy to design detector 20 so that any negative voltage within it must be provided by sensor 12. Therefore, detector 20 is very unlikely to treat any leakage of positive voltage within its circuitry as provided by the sensor 12, and no leakage of negative voltage is possible, since there is no source of negative voltage within detector 20. With the preferred design of sensor 12 shown, and assuming the polarities shown in FIG. 1, the level of negative voltage or current may be taken to indicate the presence of flame. This further immunizes detector 20 from internal failures simulating presence of the predetermined condition. In the apparatus of FIG. 1, detector 20 constantly monitors the level of the signal voltage or current on path 16, and if more negative than some predetermined level, provides a flame signal on path 21.

A first alternative detector circuit for sensing the sensor signal level indicating presence of the predetermined condition is shown in FIG. 2. This circuit uses components operating on power drawn from supply terminals at potentials defining a voltage range of one polarity, to measure the level of a sensor signal falling in a range of the other polarity, along the general principle explained in connection with FIG. 1. Sensor 12 may be assumed to be identical to that shown in FIG. 1, although one of the other types mentioned above may be used also. Sensor voltage is developed across resistor 33 by flow of the sensor current out of the ground or common terminal and through resistor 33 and path 16 into sensor 12. Detector 20 operates between voltage sources of +5 v. and 0 v. or ground.

The heart of the circuit of FIG. 2 includes an amplifier 42 functioning as an inverter and connected in a configuration allowing detection or amplification of a voltage outside the voltage range defined by the two potentials across which amplifier 42 draws its operating voltage. Amplifier 42 should be of the type which does not have an appreciable hysteresis zone for the signal voltages on its input terminals. Amplifier 42 may preferably comprise one which is generically designated model LM158A by the trade, and which is available from semiconductor manufacturers such as National Semiconductor Corporation and Motorola. Those familiar with this technology understand that when one of these operational amplifiers is functioning as an amplifier, it is operating in its linear zone, which because of the very high voltage amplifications involved, is only a few millivolts wide at the input side.

Operating power is provided to power terminals 38 and 39 respectively of amplifier 42 between ground and a +5 v. terminal symbolizing the power supply 15. The output terminal 46 of amplifier 42 is connected through a resistor 43 to the − input terminal 30 of amplifier 42.

A capacitor 44 may be placed in parallel with resistor 43 to stabilize operation of amplifier 42. The − input terminal 30 of amplifier 42 is also connected to signal path 16 through resistor 34. The ratio of the resistance values for resistors 34 and 43 is critical to the operation of this embodiment of the invention, and will be discussed in greater detail below. The + input terminal 37 of amplifier 42 is connected to a source of ground potential.

The output terminal 46 of amplifier 42 is also connected through resistor 40 to the + input terminal 31 of an amplifier connected as a comparator 45 and which may be a circuit identical to amplifier 42. The amplifier used as voltage comparator 45 is configured so that its output voltage is driven to one or the other extremes imposed by the design and by the power voltage, rather than in a linear response mode where the output voltage may have intermediate values. (It is well known that a high gain amplifier may function as a comparator where the voltage swing across the + and − input terminals is greater than the linear range.) A capacitor 41 also connects the + input terminal 31 of comparator 45 to ground, to thereby form with resistor 40, a low pass filter which removes noise, most notably 60 hz., from the signal provided by the output terminal of amplifier 42. A voltage divider comprised of resistors 47 and 48 connected between the +5 v. supply and ground provides the 1 v. threshold voltage at the − input terminal 32 of comparator 45. In a preferred embodiment, this threshold is a positive voltage 10 times the nominal voltage excursion from 0 v. at path 16 which indicates that flame is present. Thus, in the situation where the most positive voltage on path 16 which reliably indicates presence of flame is −100 mv., the voltage at the − input terminal 32 of comparator 45 provided by the voltage divider may be set at +1 v. as shown. Comparator 45 also receives on + and − power terminals 35 and 36 respectively, the same operating power from the same source as does amplifier 42. The output terminal of comparator 45 provides the condition or flame signal on path 21. A pull-down resistor 50 connects the output terminal of comparator 45 to ground to hold the voltage on path 21 at 0 v. when the condition signal is not present.

In operation, amplifier 42 functions as an inventer to perform the critical sensor signal detection function of the circuit of FIG. 2. One who understands the operation of the operational amplifier forming amplifier 42 will realize that because the output terminal of amplifier 42 is connected to the − input terminal 30 through resistor 43 and because the + input terminal 37 is connected to ground, the voltage at the − input terminal 30 will be constantly held at what is called "virtual ground". What is meant by this term is that whenever the − input terminal 30 voltage drops even a few millivolts below the + input terminal 37 voltage, the output terminal voltage will rise because of the amplifying action of amplifier 42. In this way, the amplifier 42 output voltage opposes any signal on its − input terminal 30 attempting to lower the voltage thereon. Similarly, whenever the voltage at the − input terminal 30 rises even a few millivolts above the ground voltage present at the + input terminal 37, the output terminal voltage is driven to 0 v. which opposes the rise in − input terminal 30 voltage above 0 v.

It is well known that these operational amplifiers such as the LM158A have extremely high input impedances. Accordingly, essentially all of the current flowing from the output terminal through resistor 43 must flow through resistor 34 and into path 16 assuming that resistor 33 is of the preferred very high value. Therefore, resistors 34 and 43 form a voltage divider whose center terminal is the − input terminal 30 which is held at 0 v. by action of amplifier 42. The voltage on path 16 is independently controlled by the sensor 12 as was discussed above. One can see then that the voltage produced at its output terminal 46 by amplifier 42 will be the value which satisfies the requirements of the voltage divider comprising resistors 34 and 43 as determined by the voltage on path 16. That is, with the current flow in resistors 34 and 43 identical because current flow into and out of the − input terminal 30 of amplifier 42 is negligible, then the voltage at the output terminal 46 of amplifier 42 will have a magnitude which is proportional to the ratio of the resistance of resistor 43 to the resistance of resistor 34 and be of opposite sign to the voltage at path 16.

In a preferred embodiment, the value of resistor 43 is 10 times that of resistor 34, with actual values respectively of 1 megohm and 100 kilohms. With these resistor values, $V_{out} = -101\ V_{in}$, where $V_{out}$ and $V_{in}$ are respectively the voltage at the output terminal of amplifier 42 and the voltage at path 16. If the voltage on path 16 is −100 mv., then the output terminal voltage which corresponds is +1 v. If the voltage on path 16 is −10 mv., then the output terminal 46 voltage of amplifier 42 will be +0.1 v. Of course, voltage at the output terminal 46 cannot move out of the voltage range defined by the two operating voltage potentials of 0 and +5 v.

If the voltage at path 16 which occurs when radiation from a flame impinges on sensor 12 is in the range of −100 to −300 mv., then the corresponding voltage at the output terminal of amplifier 42 will range from +1 to +3 v. If the voltage at point 32 is between −100 mv. and 0 v. (indicative of absence of flame), then the voltage at the output terminal of amplifier 42 will be between 1 and 0 v. Whatever the output voltage of amplifier 42, this signal is filtered by the capacitor 41 and resistor 40 to remove most of the high frequency noise in the signal provided to the + input terminal of comparator 45. The preferred embodiment of this circuit has the value of 100 kilohms for resistor 40 and the value of 0.001 μfd. for capacitor 41. These values remove most of the high frequency noise and at the same time avoid attenuation of the signal voltage.

If −100 mv. is the value selected as defining the voltage range at point 32 for the predetermined condition, then 1 v. is the threshold value needed at the − input terminal of comparator 45. This may be conveniently provided by setting the values of resistors 47 and 48 at 400 kilohms and 100 kilohms respectively to provide the threshold voltage. However, there is some inaccuracy which arises with generating the reference voltage in this manner, and one may rather wish to use a voltage standard circuit specifically designed for that purpose. From the foregoing, one can see that detector 20 in FIG. 2 can, by using a +5 v. power source, discriminate between voltages above and below −100 mv. and outside the voltage range established by the potentials at the two terminals providing DC power for the detector 20.

Those familiar with operational amplifiers will see that comparator 45 operates in a non-inverting fashion, where a voltage above +1 v. at the + input terminal 31 causes an output voltage near the higher operating voltage of +5 v. As explained above, comparator 45 is not operating in its linear region, and this distinguishes its function from the operation of amplifier 42. However, it is convenient to use a LM158A amplifier as comparator 45 since this device is available from the manufacturers in a dual amplifier package.

Figure 4:
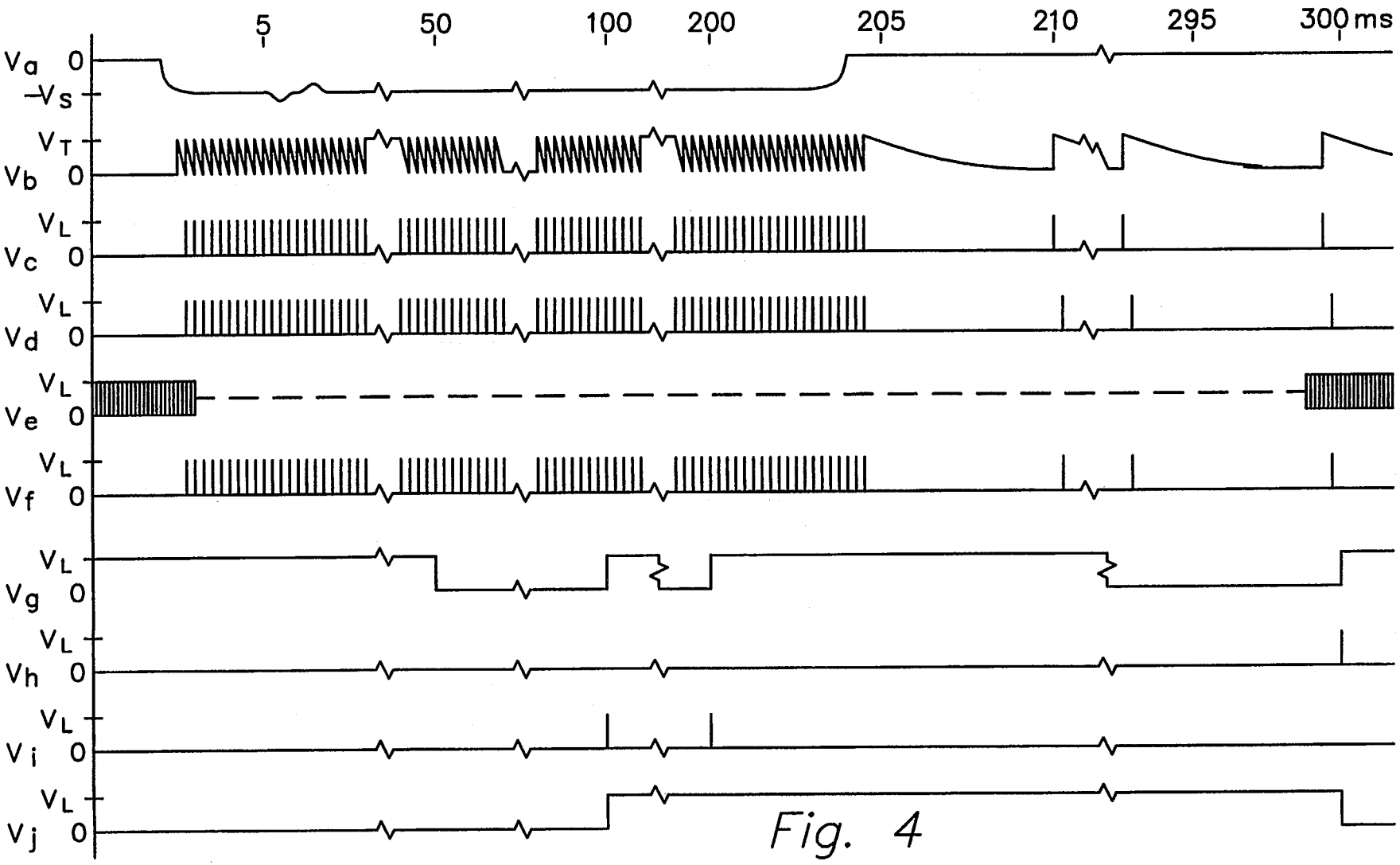
FIG. 4 displays a number of waveforms useful in understanding the operation of the circuit of FIG. 3.

The second alternative detector circuit 20 shown in FIG. 3 forms a commercial embodiment of the invention. It is helpful to refer to the waveforms of FIG. 4 in understanding the operation of the circuit of FIG. 3. The labels on each of the waveforms in FIG. 4 correspond to the voltages on the signal paths adjacent the similar labels in the circuit schematic of FIG. 3. Also, the time scale on the waveforms of FIG. 4 is in milliseconds, but substantial portions of the time scale have been omitted at various points where the zigzag marks have been inserted. The reader should be alert to the fact that these omissions have been made. As reference is made to the various waveforms of FIG. 4 throughout the explanation of the circuit shown in FIG. 3, a shorthand notation will be used to identify various features of interest in the waveforms. In this notation, the waveform designation, e.g. $V_a$, will be followed by a reference to the time scale at the top of FIG. 4. For example, the change in $V_a$ from 0 v. to $-V_S$ at about 2 msec. on the time scale will be identified as feature $V_a$2.

In the circuit of FIG. 3 also, sensor 12 can be assumed to provide a signal similar to that of the sensor shown in FIG. 1. As explained previously, in my preferred embodiment, sensor 12 provides a relatively low level output voltage, say of approximately −100 mv. to −50 mv. with a current of around −0.5 μamp. or more negative in response to presence of a flame, and approximately −10 mv. to 0 v. and −0.1 μamp. to 0 μamp. when no flame is present.

The detector circuit 20 of FIG. 3 consists of two sections, a digitizer and a counter/tester. The digitizer section provides transitions of its output signal from a logical 0 to a logical 1 at a rate proportional to the current level into sensor 16. The counter/tester counts these transitions over a predetermined interval and senses whether the sensor 12 current exceeds a predetermined value.

Considering the digitizer first, a resistor 62 connects the voltage $V_a$ provided by sensor 12 on path 16 to a signal terminal 66 of a capacitor 55. Capacitor terminal 54 is connected to ground. The voltage $V_b$ across capacitor 55 is supplied to the − input terminal (shared with the signal terminal 66 of capacitor 55) of a comparator 56. The impedance at the − input terminal 66 of comparator 56 is extremely high, so the voltage across capacitor 55 is not affected by comparator 56. Comparator 56 is powered by the potential developed between a positive voltage and ground as is shown by the connection of its + power terminal 59 to the power supply symbolized by +5 v. power terminal 15. The − input terminal 66 and − power terminal 54 of comparator 56 (both terminals being shared with capacitor 55) are both connected to ground. With this connection, one can see that the comparator 56 output voltage $V_c$ will be very close to ground or 0 v. when the voltage on the comparator's − input terminal 66 is at or above 0 v., and at some value substantially more positive than ground, say $+V_L$ (a logical 1 value), when the − input terminal 66 of comparator 56 is below ground voltage. Comparator 56 is preferably one which has a hysteresis zone for voltages applied to its input terminals 66 and 54, so that the output voltage will not change until there is something greater than around a 10 mv. difference between the voltages on the + and − input terminals.

The output signal from comparator 56 is applied to the data (D) input of a D flip-flop 67. Comparator 56 and flip-flop 67 as well as all of the other elements of the circuit shown in FIG. 3 which use or generate digital signals can be assumed to use 0 v. to represent a Boolean or logical 0 and $+V_L$ to represent logical 1. D flip-flop circuits are familiar to those skilled in logic circuit design as transferring the logical value at the D input to the Q output when there is a transition from logical 0 to logical 1 at the CLK (clock) input. The Q output of a D flip-flop can only be changed when the logical 0 to logical 1 transition at the CLK input occurs. The Q output of flip-flop 67 is shown as waveform $V_d$ in FIG. 4. The CLK input to flip-flop 67 is supplied by a 100 μsec. clock module 51 which provides a clock signal having alternating 50 μsec. intervals of logical 0 and logical 1 voltage levels. FIG. 3 also shows this 100 μsec. cycle time clock signal at the output path of clock module 51 and FIG. 4 shows the 100 μsec. clock signal as waveform $V_e$. Since there are 10 complete cycles of clock module 51 output per msec., the details of each transition cannot be shown in waveform $V_e$ at the scale chosen for FIG. 4.

The clock module 51 output is also supplied to a delay circuit 63 which in this embodiment may have a value of 1 μsec. although any value substantially less than 100 μsec. is acceptable. Delay circuit 63 thus supplies the clock module 51 output delayed by 1 μsec. to one input of an AND gate 68. AND gate 68 also receives at a second input the Q output from flip-flop 67. It can thus be seen that each time the clock module 51 output changes from a logical 0 to a logical 1 and the Q output of flip-flop 67 is a logical 1, there will be a similar logical 0 to logical 1 change in the output of AND gate 68.

Capacitor 55 is periodically charged by current whose flow to capacitor 55 from power supply 15 is controlled by an analog switch 53 whose first power terminal 69 is connected to power supply 15. The second power terminal 57 of analog switch 53 is connected to the capacitor's terminal 66 by resistor 58. Resistor 58 and switch 53 along with power supply 15 comprise a charging circuit for capacitor 55. Opening and closing of switch 53 is controlled by the logic signal on its ENABLE input, where a logical 0 opens and a logical 1 closes switch 53.

The output of AND gate 68 forms the output signal of the digitizer and is provided to the INCR (increment) input of a counter 60 which forms part of the counter/tester. Each time a logical 0 to logical 1 transition occurs on the INCR input of counter 60, an internally stored digital count value is increased by 1. This digital count value in counter 60 is supplied in an output to the DATA input of a digital value (as opposed to an analog voltage) comparator 61. The normal outputs of comparator 61 on paths 70 and 71 are logical O's. Comparator 61 tests the digital value provided by counter 60 when a logical 0 to logical 1 transition occurs at an ENABLE input. In the particular embodiment here, if the value in counter 60 is greater than or equal to 32 when the logical 0 to 1 transition occurs on the ENABLE input, then a short logical 1 pulse is provided on path 71 to the S (set) input of an S-R flip-flop 65 with the logical 0 signal on path 70 continuing to be applied to its R (reset) input. The output signal of comparator 61 on path 71 is shown as waveform $V_i$ in FIG. 4. If the value in counter 60 is less than 32 when the ENABLE input receives the logical 1 signal, then the logical 0 signal on path 71 to the S input of flip-flop 65 is maintained and a logical 1 pulse is supplied on path 70 to the R input of flip-flop 65. The waveform for the voltage on path 70 is shown in FIG. 4 as $V_h$. The 1 output of flip-flop 65 forms the flame signal supplied on path 21, shown in FIG. 4 as waveform $V_i$. A 100 msec. clock module 52 supplies a balanced square wave (waveform $V_g$) to the ENABLE input of comparator 61. Waveform $V_g$ consists of alternating 50 msec. logical 1 and logical 0 voltage levels. Clock module 52 output is also supplied to a CLR (clear) input of counter 60 by which the internal count value of counter 60 is reset to 0. The CLR input is applied through a delay circuit 64 which delays the clock signal pulses a few microseconds so as to allow comparator 61 to test the value contained in counter 60 before it is cleared.

In my preferred embodiment, the actual hardware elements shown in FIG. 3 are formed in a special purpose microcircuit. It is also possible to implement the functions shown in FIG. 3 of clock modules 51 and 52, counter 60, comparator 61, delay circuit 63 and 64, and flip-flops 67 and 65 by a suitably programmed microprocessor receiving the output of comparator 56. Such embodiments are within the scope of my invention although not currently preferred. One should also note that in such an implementation, the microprocessor and the program storage element may be actually considered the physical equivalent of each of these circuit elements as their respective functions are invoked by the execution of the related instructions.

In the circuit in FIG. 3, the digitizer section of detector 20 senses current flow generated by sensor 12. The level of the negative current flow into sensor 12 through resistor 62 controls the rate at which capacitor 55 is discharged, or perhaps more accurately, the rate at which the voltage at terminal 66 (waveform $V_b$) across capacitor 55 becomes less positive. The capacitor 55 is charged to a more positive voltage at terminal 66 by operation of the analog switch 53 and a current limiting resistor 58 whenever the voltage at terminal 66 falls below 0 v. Switch 53 conducts when a logical 1 is present on its enable input, and does not conduct otherwise. Current provided by the +5 v. terminal symbolizing power supply 15 flows to capacitor 55 under the control of D flip-flop 67 which operates in the following manner. When voltage at the − input terminal of comparator 56 falls below the negative-going switching point of around −50 mv. to −10 mv., for comparator 56, then first at $V_b2$ and approximately every half msec. thereafter until $V_b203$ as shown in FIG. 4, comparator 56 provides a logical 1 pulse to the D input of flip-flop 67. These logical 1 pulses are shown starting at $V_c2$ as positive-going spikes narrower than 100 μsec. whose leading edges coincide with the instant that waveform $V_b$ falls below 0 v.

On each logical 0 to logical 1 transition of clock module 51 the logical 1 or logical 0 value at the D input is transferred to the Q output of flip-flop 67. A logical 1 at the Q output terminal of flip-flop 67 when flip-flop 67 is set causes switch 53 to conduct. Current immediately starts to flow through resistor 58 to capacitor 55 and $V_b$ becomes more positive. As waveform $V_b$ voltage rises above the positive-going switching value of comparator 56 which is typically very close to 0 v., an event which usually takes a few tens of μsec. to occur, $V_c$ again drops to a logical 0 voltage. Each time the 100 μsec. clock 51 transition from logical 0 to logical 1 occurs, the logical value at the D input is transferred to the Q output of flip-flop 67. If 100 μsec. of current to capacitor 55 is enough to lift the voltage $V_b$ at point 66 to change the output of comparator 56 to a logical 0 then flip-flop 67 is cleared by the next 0 to 1 transition of clock module 51 output. In certain circumstances it may take two or more clock module 51 cycles to charge capacitor 55 to a voltage above ground where sensor current is particularly large. Resistor 58 may be chosen to allow current flow to capacitor 55 from power supply 15 anywhere from five to 50 times as fast as current is expected to be drawn from capacitor 55 by sensor 12 when flame is present.

In my preferred embodiment, resistor 58 is chosen to allow current flow of 25 μamp. when switch 53 is closed. Since there are 1000 hundred μsec. intervals in a 100 msec. interval, by counting the number of 100 μsec. intervals during which switch 53 is closed in a 100 msec. interval, a very accurate measure of the average current flow through resistor 62 to sensor 12 is available. For example, if 32 counts are detected in a 100 msec. interval, the average current flow to capacitor 55 from power supply 15 is (32/1000) ×25 μamp. or 0.8 μamp. In fact this is the current flow criterion used in my preferred embodiment to signify presence of flame.

Following the delay created by delay circuit 63 after a logical 0 to logical 1 transition of clock module 51, if the Q output of flip-flop 67 has a logical 1 level, AND gate 68 provides a logical 0 to logical 1 transition to counter 60 which causes the internally recorded digital value of counter 60 to increment by 1. As one can infer from FIG. 4 and particularly from the fact that approximately 2 to 3 transitions occur each msec. in waveform $V_d$, a strong flame current is generated between 2 and 204 msec. and the counts registered in counter 60 will run in the range of 200 to 300. Thus, the count greatly exceeds 32 at the end of the 100 and 200 msec. points in FIG. 4, and as each transition from logical 0 to logical 1 from clock module 52 occurs, the comparator 61 receives an ENABLE transition and provides a pulse on path 71. Thus, assuming that at 0 msec. flip-flop 65 was in its cleared state, its 1 output will change from a logical 0 to a logical 1 at 100 msec. The process repeats itself between 100 and 200 msec., with the result that the waveform $V_j$ does not change at 200 msec.

One can see that at the end of each 100 msec. period, counter 60 contains the number of 100 μsec. intervals that switch 53 has been closed during the 100 msec. interval. Counter 60 thus forms part of a summation means which cumulates the total time during which the comparator 56 output is a logical 1 during each 100 msec. interval. The time is cumulated in counter 60 as the fractional part of the 1000 intervals each 100 μsec. long in a 100 msec. interval. In this embodiment, if this fraction is greater than 31/1000, then the flame signal is provided on path 21.

To further explain the operation of this circuit, the sensor signal on path 16, waveform $V_a$, is shown as changing from $-V_s$ at 203 msec. to near 0 v. at 205 msec., indicating that the flame has gone out. Waveform $V_a$ thus shows a relatively rapid change, although in practice the change may be substantially more gradual, occurring over several hundred msec. Whatever the actual shape of the sensor signal voltage as shown in waveform $V_a$, as it become less negative, the capacitor 55 discharges less rapidly, so that its voltage reaches 0 v. more slowly. Accordingly, the interval between successive transitions from logical 0 to logical 1 of the Q output from flip-flop 67 becomes longer, and the same becomes true for the transitions from logical 0 to logical 1 applied to the INCR input of counter 60. One can see that in fact the time between each transition in waveforms $V_c$ and $V_f$ after time 204 msec. is about 6 msec. These transitions arise because of a small amount of current leakage in the flame rod sensor even after the flame has gone out.

There are thus in waveform $V_f$ between times 200 and 204 msec., the 10 pulses shown and between times 204 and 300 msec., approximately 16 pulses, for a total of 26. This is less than 32, so at 300 msec. the ENABLE signal to comparator 61 causes a pulse to occur on path 70 as shown in waveform $V_h$, clearing flip-flop 65 to indicate a flame out condition on the flame signal of path 21 and at $V_j$300.

The count value for comparator 61 should be selected on the basis of indicating presence of flame when the flame current carried by path 16 averages greater than −0.80 μamp., which is the accepted current level providing ample margin to assure absolute safety in detecting flame out conditions. The indicated count value of 32 as the criterion used by comparator 61 is dependent on the values selected for resistor 58 and the power supply 15 voltage. Other values for these parameters will of course change the count value. In other applications of this invention, another count parameter may well be needed, to be determined by experimentation or analysis of the particular application.

What I claim is:

1. Apparatus for signaling presence of a predetermined condition by providing a condition signal having a predetermined level, comprising:

a) a sensor having a power terminal and providing, responsive exclusively to existence of the predetermined condition and to presence of operating power on the power terminal, a sensor signal having a level within a predetermined signal voltage range offset in a first direction from a common voltage level;

b) a first power supply providing operating power to the sensor's power terminal;

c) a detector having a power terminal, and receiving the sensor signal and providing the condition signal with the predetermined level responsive exclusively to the sensor signal level being within the predetermined signal voltage range and to presence on the detector power terminal of a predetermined power voltage whose level defines one end of a predetermined power voltage range offset in the opposite direction relative to the common voltage level from the offset direction of the sensor signal level's predetermined voltage range; and d) a second power supply providing the predetermined power voltage to the detector's power terminal.

2. The apparatus of claim 1, wherein the detector includes an inverter receiving the sensor signal at an input terminal and providing at the output terminal an inverted sensor signal having polarity opposite that of the sensor signal, and a comparator providing the condition signal having the predetermined level responsive to the inverted sensor signal crossing a predetermined voltage level.

3. The apparatus of claim 2, wherein the inverter includes a first differential amplifier and the comparator includes a second differential amplifier, each differential amplifier having a power terminal connected to the detector's power terminal, and wherein the first differential amplifier is of the type whose output signal changes responsive to an input signal voltage applied to the first differential amplifier crossing the voltage at the power terminal thereof.

4. The apparatus of claim 3, wherein the sensor includes sensor means for generating a DC sensor signal having voltage within the predetermined signal voltage range when the predetermined condition exists, and the first differential amplifier includes first and second input terminals and an output terminal, and the inverter further includes a first resistor connecting the first differential amplifier output and second input terminals, a second resistor having a resistance which is a fraction of the resistance of the first resistor and which conducts the sensor signal to the first differential amplifier second input terminal, and a conductor connecting the first differential amplifier's first input terminal to a source of the common voltage.

5. The apparatus of claim 4, wherein the second differential amplifier includes first and second input terminals and an output terminal; and wherein the comparator further includes a connection between the first differential amplifier's output terminal and the second differential amplifier's first input terminal, and a threshold voltage source element connected to receive the power voltage from the second power supply and converting said power voltage to a threshold voltage falling within the predetermined power voltage range, and supplying said threshold voltage to the second differential amplifier's second input terminal.

6. The apparatus of claim 1, wherein the second power supply includes a ground terminal providing the common voltage level, and wherein the detector further includes:

a) a capacitor having first and second terminals, said first terminal thereof connected to the second power supply's ground terminal and receiving the sensor signal on the second terminal thereof;

b ) a voltage comparator having first and second input terminals, a power terminal receiving operating power from the second power supply, and an output terminal providing the output signal, the comparator's first and second input terminals connected respectively to the second power supply's ground terminal and the capacitor's second terminal, wherein the comparator's output signal has a second level when the voltage at the second input terminal thereof is within the signal voltage range, and a first level otherwise; and c) charging circuit means connected to receive the output signal of the comparator for applying a DC voltage within the predetermined power voltage range to the capacitor's second terminal for a preselected time responsive to the second level of the voltage comparator's output signal, said DC voltage and preselected time being sufficient to cause the capacitor voltage to reach the predetermined power voltage range.

7. The apparatus of claim 6, further including counter means receiving the comparator output signal, for cumulating the time when the second level of the comparator output signal is present, and responsive to presence of the second level of the comparator output signal for at least a preselected fraction of a preselected time, providing the condition signal with the predetermined level.

8. The apparatus of claim 7, wherein the sensor receives electric current at its power terminal from the first power supply and provides as the sensor signal a current whose magnitude is greater than a predetermined current level responsive to presence of the predetermined condition.

9. The apparatus of claim 6, wherein the sensor receives electric current at its power terminal from the first power supply and provides as the sensor signal a current whose magnitude is greater than a predetermined current level responsive to presence of the predetermined condition.

10. The apparatus of claim 1, wherein the detector includes a) digitizer means receiving the sensor signal for providing a series of pulses whose spacing is representative of the deviation of the sensor signal from the common voltage level, and b) counter means receiving the series of pulses from the digitizer means for counting the number of pulses within an interval of predetermined length and for issuing an output signal encoding the number of pulses

11. The apparatus of claim 10, further comprising a digital value comparator means receiving the output signal from the counter means for providing the condition signal with the predetermined level responsive to the number of pulses encoded in the Output signal from the counter means exceeding a predetermined value.

12. The apparatus of claim 10, wherein the second power supply includes a ground terminal providing the common voltage level, and wherein the digitizer means further comprises a) a capacitor receiving the sensor signal at a first terminal and connected at a second terminal to the second power supply's ground terminal;

b) a voltage comparator having a first input terminal connected to the first terminal of the capacitor and a second input terminal connected to the second power supply's ground terminal, and providing a logic output signal having a first logic value while the voltage at the first input terminal is greater than the voltage at the second input terminal, and a second value otherwise;

c) a flip-flop receiving the voltage comparator logic output signal and providing a flip-flop logic output signal having a first value for a predetermined clocking time responsive to a predetermined logic level of the voltage comparator signal; and d) an analog switch having a first power terminal connected to the detector power terminal, a second power terminal connected to the voltage comparator's first terminal, and an enable terminal receiving the flip-flop's logic output signal, said analog switch conducting between its first and second power terminals responsive to a preselected value of the flip-flop logic output signal, whereby the sensor signal changes the capacitor voltage in a direction of increasing difference from the detector's power terminal voltage, and conduction by the analog switch changes the capacitor voltage in a direction of decreasing difference from the detector's power terminal voltage.

13. The apparatus of claim 12, wherein the digitizer means further comprises a clock module providing a clock signal having a cycle time corresponding to the predetermined clocking time, and wherein the flip-flop receives the clock signal and sets the flip-flop's logic output signal value to the voltage comparator logic value once each cycle time.

* * * * *